United States Patent [19]

Seemann et al.

[11] Patent Number: 5,001,462

[45] Date of Patent: Mar. 19, 1991

[54] PERSONAL SAFETY ALARM AND LIGHT

[76] Inventors: LaVonne A. Seemann; Warren A. Sandquist, both of 635 Prairie Ctr. Dr., Eden Prairie, Minn. 55344

[21] Appl. No.: 471,870

[22] Filed: Jan. 29, 1990

[51] Int. Cl.[5] ..... G08B 15/00

[52] U.S. Cl. ..... 340/574; 340/693; 362/234; 362/253

[58] Field of Search ..... 340/574, 693; 362/253, 362/234, 250, 458

[56] References Cited

U.S. PATENT DOCUMENTS

| | | | |
|---|---|---|---|
| 3,727,657 | 4/1973 | Landis | 150/35 |
| 4,118,692 | 10/1978 | Fitchett | 340/542 |
| 4,245,218 | 1/1981 | Berkebile et al. | 340/574 |
| 4,535,392 | 8/1985 | Montgomery | 362/258 |
| 4,638,412 | 1/1987 | Weigert | 362/156 |
| 4,654,763 | 3/1987 | Knight | 362/156 |
| 4,742,438 | 5/1988 | King | 362/137 |
| 4,837,559 | 6/1989 | Green, Sr. | 340/574 |

*Primary Examiner*—Glen R. Swann, III

*Attorney, Agent, or Firm*—Merchant, Gould, Smith, Edell, Welter & Schmidt

[57] ABSTRACT

A personal safety alarm and light device can be either worn by a user or releasably attached to a handbag or purse. The device provides both an audible and visual alarm that can be actuated in threatening or dangerous circumstances. In addition, it provides a steady source of illumination to function in a manner similar to a flashlight. It also has a light source that flashes and can be used when the device is worn by a jogger or a bicyclist to make the person more visible when that person exercises in diminished ambient light.

15 Claims, 1 Drawing Sheet

PERSONAL SAFETY ALARM AND LIGHT

BACKGROUND OF THE INVENTION

The present invention relates to a personal safety alarm and light that can either be worn by a user or concealed in a handbag. There are numerous occasions when a person may find himself or herself alone in areas or situations where he/she is the potential target of attacks. For example, there have been many reported cases of muggings in darkened parking lots and garages and against joggers running alone. The carrying of chemicals intended to disable an attacker may not be a totally satisfactory solution to this problem since there is a potential that the chemical can be used against the carrier. In addition, there are numerous occasions when a person simply needs a handy flashlight.

The prior art includes a number of devices designed to illuminate the interior of a lady's purse or pocketbook. Examples of such devices are disclosed in U.S. Pat. Nos. 4,742,438; 4,654,763; and 4,638,412. The prior art also includes anti-theft devices for handbags that generate both an audible and visual alarm upon unauthorized attempts to open the handbag. An example of such a device is shown in U.S. Pat. No. 4,118,692.

The present invention combines the features of a portable audible and visual alarm that can be activated in a threatening situation and which, in addition, can function as a flashlight.

SUMMARY OF THE INVENTION

The present invention is a personal alarm and light device which can be worn by the user or alternatively releasably attached to a handbag. The device has an audible and visual alarm which can be actuated by the user. In addition, the device incorporates a light separate from the alarm which can be turned on to provide a steady source of illumination. The device may also include a third light source providing a flashing or intermittent light which, when the device is worn by a jogger or bicyclist, will assist in identifying the person to a motorist in low ambient light conditions. In the preferred embodiment, the device has a strap which can be used to secure the device to the arm or leg of the user. The strap has a Velcro® type material which is designed to cooperate with complementary Velcro® type material affixed to a handbag so that the device could alternatively be attached to the handbag of the user.

Advantages of the present invention will become apparent with reference to the accompanying drawings, detailed description of the preferred embodiment, and claims.

DETAILED DESCRIPTION OF THE PREFERRED EMBODIMENT

Figure 1:
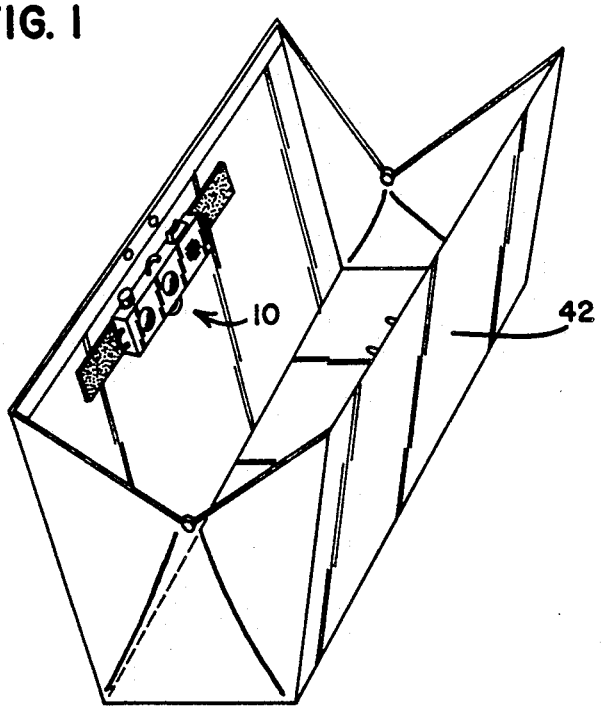
FIG. 1 is a view in perspective showing the personal safety alarm and light device releasably attached to the interior of a handbag.

Referring to the drawings, wherein like numerals represent like parts throughout the several views, the personal safety alarm and light device is illustrated generally at 10. The device includes a housing 12 which, in the preferred embodiment, is a translucent material. Mounted within housing 12 is an audible alarm shown in block diagram form at 14 in FIG. 4. It should be understood that alarm 14 can be any conventional prior art electrically powered alarm emitting a loud noise upon actuation. Typically alarm 14 will have associated therewith a speaker which may be positioned behind a grill 16 in housing 12. Also disposed within housing 12 is a visual alarm indicated generally in block diagram form 18 in FIG. 4. The preferred embodiment of visual alarm 18 is a light bulb positioned behind a cover 20 in housing 12. Light cover 20 may, for example, be colored red. The visual alarm light bulb may be connected in a conventional prior art electrical circuit so that when it is turned on it will emit an intermittent or flashing signal. Thus, the visual alarm signal will appear through cover 20 as a flashing red light.

Figure 4:
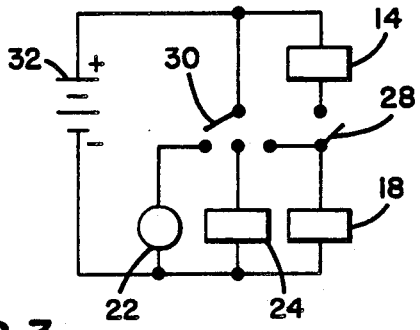
FIG. 4 is an electrical block diagram illustrating the connection of the electrical components of the device.
Figure 3:
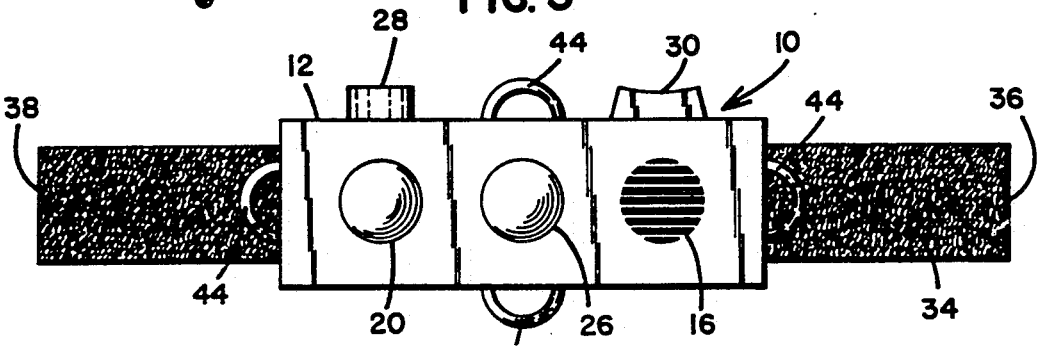
FIG. 3 is a plan view of the device of the present invention.

Also disposed within housing 12 is a light bulb 22 designed to provide a steady source of illumination. Since the housing 12 is of translucent material, when the light 22 is turned on, device 10 will function as a flashlight illuminating, for example, the interior of a handbag so that the user could find desired items such as car keys. Also disposed within housing 12 is a third light source 24. Light source 24 includes a bulb and associated circuitry well known in the prior art to generate a flashing or intermittent light signal. The light bulb of light source 24 is positioned in housing 12 behind a cover 26. Cover 26 in the preferred embodiment is an amber color. Device 10 includes a push button switch 28 that functions to simultaneously turn on and off audible alarm 14 and visual alarm 18. Switch 28 may be of a type known in the prior art that, when depressed, will actuate alarm 14 and visual alarm 18 and will remain in the on condition when released. Alarms 14 and 18 are turned off by again depressing switch 28, releasing it from the on condition and allowing it to return to the off position. Device 10 also includes a switch 30. As shown in FIG. 4, switch 30 is a four-position switch having an off position, a first position to turn on the light bulb 22, a second position to turn on the light source 24 and, if desired, a third position which would turn on the visual alarm 18 without turning on the audible alarm 14. Also disposed within housing 12 is a replaceable and/or rechargeable battery power source 32.

Figure 2:
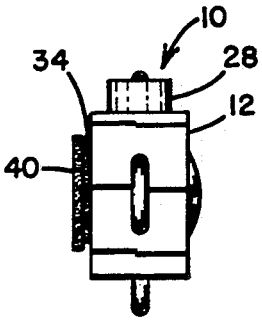
FIG. 2 is a side elevational view of the device, showing its manner of attachment to the handbag.

Attached to housing 12 is a strap 34 that can be used to attach device 10 around the arm or leg of a user of the device. Although any convenient means could be used, it is contemplated in the preferred embodiment that the ends 36 and 38 of strap 34 are provided with complementary hook and loop )Velcro® type) fastening means that releasably secure the ends 36 and 38 together. Strap 34 may be affixed to housing 12 by any convenient means. As shown in FIG. 2, strap 34 has a member 40 adapted to mount device 10 to a handbag 42 and, in particular, the interior of the handbag as shown in FIG. 1. In the preferred embodiment, mounting member 40 includes a Velcro ® type material and a complementary strip of Velcro® type material may be affixed to the interior of handbag 42. Complementary Velcro® type material on member 40 and handbag 42 provide means for releasably attaching device 10 to handbag 42. Affixed to and integral with housing 12 are a plurality of loop members 44. Loop members 44 allow device 10 to be carried by a user in some manner other than with strap 34. For example, a belt could be threaded through oppositely disposed loop members 44 whereby device 10 could be worn on the belt of a user of the device.

In operation, when a user of device 10 felt threatened, he or she could actuate audible alarm 14 and visual alarm 18. The alarm would remain actuated until turned off by the user. Alternatively, a user could, if desired, actuate the visual alarm 18 using switch 30 without simultaneously causing an audible alarm to sound. A jogger or bicyclist may find it advantageous to wear device 10 around an arm or leg with the light source 24 turned on so that he or she could be more readily observed when exercising in diminished light. Device 10 could also be used in a manner such as a conventional flashlight by turning on light bulb 22 providing a source of illumination through translucent housing 12. The present invention thus provides a simple and portable personal alarm and safety device having multiple uses. It can be worn by the user either externally or concealed or can be carried in a handbag. It will be understood that in addition to its utilitarian functions, it will give the user an actual sense of security when alone in potentially threatening circumstances.

We claim:

1. A personal safety alarm and light device comprising:

a housing;

means for removably attaching said housing to the body of a user of the device;

an audible alarm mounted within said housing;

first switch means for actuating said alarm;

light means within said housing for providing illumination;

second switch means for actuating said light means;

a power supply within said housing to provide power to said alarm and said light means.

2. A personal safety alarm and light device in accordance with claim 1 further comprising a second light means within said housing for providing a flashing light signal upon actuation of said first switch means.

3. A personal safety alarm and light device in accordance with claim 1 further comprising a second light means within said housing for providing a flashing light signal and switch second light means for actuating said means.

4. A personal safety alarm and light device in accordance with claim 1 wherein said removable attaching means comprises a strap secured to said housing and adapted to encircle a limb of a user of the device.

5. A personal safety alarm and light device in accordance with claim 4 wherein said strap has a means for securing the device to a handbag.

6. A personal safety alarm and light device in accordance with claim 5 wherein said securing means comprises a hook and loop material affixed to said strap and adapted to cooperate with complementary hook and loop material affixed to a handbag.

7. A personal safety alarm and light device comprising:

a housing;

means for removably attaching said housing to the body of the user of the device;

an audible alarm mounted within said housing;

first light means within said housing for providing a flashing light signal indicating an emergency;

first switch means for simultaneously actuating said audible alarm and said first light means;

second light means within said housing for providing a second flashing light signal;

third light means within said housing for providing a steady source of illumination;

second switch means for selectively actuating said second and third light means;

a battery power supply within said housing to power said audible alarm and said first, second, and third light means.

8. A personal safety alarm and light device in accordance with claim 7 wherein said removable attaching means comprises a strap secured to said housing and adapted to encircle a limb of the user of the device.

9. A personal safety alarm and light device in accordance with claim 8 wherein said strap has a means for securing the device to a handbag or purse.

10. A personal safety alarm and light device in accordance with claim 9 wherein said securing means comprises a hook and loop material affixed to said strap and adapted to cooperate with complementary hook and loop material affixed to a handbag.

11. In combination a handbag and a personal safety alarm and light device comprising:

a housing;

an audible alarm mounted within said housing;

first switch means for actuating said alarm;

light means within said housing for providing illumination;

second switch means for actuating said light means;

a power supply within said housing to power said audible alarm and said first light means;

first means on said housing for attaching said device to said handbag; and second means affixed to said handbag for cooperating with said first attachment means on said housing to attach said device to said handbag.

12. The combination in accordance with claim 11 wherein said first means comprises a hook and loop material affixed to said housing and wherein said second attachment means comprises a hook and loop material affixed to said handbag for cooperating with said hook and loop material on said housing whereby said device is releasably attached to said handbag.

13. The combination in accordance with claim 11 further comprising a second light means within said housing for providing a flashing light signal upon actuation of said first switch means.

14. The combination in accordance with claim 11 further comprising a second light means within said housing for providing a flashing light signal and switch means for actuating said second light means.

15. In combination with a handbag, a personal safety alarm and light device, said handbag having a means for releasably securing said device to said handbag, said device comprising:

a housing;

a strap secured to said housing and adapted to encircle a limb of a user of the device to removably attach the device to a user, said strap having a means cooperating with said releasable securing means on said handbag to releasably secure said device to said handbag;

an audible alarm mounted within said housing;

first light means within said housing for providing a flashing light signal indicating an emergency;

first switch means for simultaneously actuating said audible alarm and said first light means;

a second light means within said housing for providing a second flashing light signal;

third light means within said housing for providing a steady source of illumination;

a second switch means for selectively actuating said second and third light means;

a battery power supply within said housing to power said audible alarm and said first, second and third light means.

* * * * *